US011069970B2

(12) United States Patent
Leipold et al.

(10) Patent No.: US 11,069,970 B2
(45) Date of Patent: Jul. 20, 2021

(54) MULTI-RADIO ACCESS TECHNOLOGY ANTENNA ASSEMBLY AND RELATED FRONT-END PACKAGE

(71) Applicant: Qorvo US, Inc., Greensboro, NC (US)

(72) Inventors: Dirk Robert Walter Leipold, San Jose, CA (US); George Maxim, Saratoga, CA (US); Baker Scott, San Jose, CA (US)

(73) Assignee: Qorvo US, Inc., Greensboro, NC (US)

( * ) Notice: Subject to any disclaimer, the term of this patent is extended or adjusted under 35 U.S.C. 154(b) by 146 days.

(21) Appl. No.: 16/205,662

(22) Filed: Nov. 30, 2018

(65) Prior Publication Data

US 2020/0028253 A1 Jan. 23, 2020

Related U.S. Application Data

(60) Provisional application No. 62/699,802, filed on Jul. 18, 2018.

(51) Int. Cl.
*H01Q 1/38* (2006.01)
*H01Q 1/52* (2006.01)
(Continued)

(52) U.S. Cl.
CPC ..... *H01Q 1/523* (2013.01); *H01Q 1/243* (2013.01); *H01Q 5/50* (2015.01); *H01Q 21/0025* (2013.01); *H01Q 21/064* (2013.01)

(58) Field of Classification Search
CPC .. H01Q 1/523; H01Q 21/064; H01Q 21/0025; H01Q 5/50; H01Q 1/243;
(Continued)

(56) References Cited

U.S. PATENT DOCUMENTS 4,775,866 A * 10/1988 Shibata ..... H01Q 9/0407 343/700 MS
4,816,836 A * 3/1989 Lalezari ..... H01Q 21/065 156/215

(Continued)

FOREIGN PATENT DOCUMENTS

JP 2005167830 A * 6/2005

*Primary Examiner* — Dieu Hien T Duong
(74) *Attorney, Agent, or Firm* — Withrow & Terranova, P.L.L.C.

(57) ABSTRACT

A multi-radio access technology (RAT) antenna assembly and related front-end package is provided. In one aspect, the multi-RAT antenna assembly includes a radiating structure that radiates/absorbs a first electromagnetic wave corresponding to a first RAT in a first RF spectrum (e.g., below 6 GHz). A number of slot openings are created in the radiating structure to function as a number of slot antennas for radiating/absorbing a second electromagnetic wave corresponding to a second RAT in a second RF spectrum (e.g., above 18 GHz). As such, the multi-RAT antenna assembly can support both the first RAT and the second RAT based on the radiating structure, thus helping to reduce real estate requirements of the multi-RAT antenna assembly. In another aspect, a front-end circuit supporting the second RAT is coupled to the slot openings via shortest possible paths in a front-end package, thus helping to reduce propagation attenuation in the front-end package.

19 Claims, 10 Drawing Sheets

(51) Int. Cl.

| | |
|---|---|
| ***H01Q 21/06*** | (2006.01) |
| ***H01Q 21/00*** | (2006.01) |
| ***H01Q 5/50*** | (2015.01) |
| ***H01Q 1/24*** | (2006.01) |

(58) Field of Classification Search
CPC ..... H01Q 5/35; H01Q 21/08; H01Q 21/005; H01Q 5/40; H01Q 21/28; H01Q 13/10
See application file for complete search history.

(56) References Cited

U.S. PATENT DOCUMENTS

| | | | | |
|---|---|---|---|---|
| 2005/0219134 | A1* | 10/2005 | Sergey | H01Q 13/22 343/770 |
| 2009/0153410 | A1* | 6/2009 | Chiang | H01Q 13/10 343/702 |
| 2016/0302208 | A1* | 10/2016 | Sturkovich | H04L 5/08 |
| 2018/0261566 | A1* | 9/2018 | Babcock | H03H 7/00 |
| 2019/0103653 | A1* | 4/2019 | Jeong | H01L 25/0655 |
| 2019/0123441 | A1* | 4/2019 | Sudo | H01Q 3/2635 |
| 2019/0379119 | A1* | 12/2019 | He | H01Q 25/00 |
| 2020/0106171 | A1* | 4/2020 | Shepeleva | H01Q 21/064 |

* cited by examiner (A-A')

(B-B')

(B-B')

MULTI-RADIO ACCESS TECHNOLOGY ANTENNA ASSEMBLY AND RELATED FRONT-END PACKAGE

RELATED APPLICATIONS

This application claims the benefit of provisional patent application Ser. No. 62/699,802, filed Jul. 18, 2018, the disclosure of which is hereby incorporated herein by reference in its entirety.

FIELD OF THE DISCLOSURE

The technology of the disclosure relates generally to an antenna structure and related front-end circuit.

BACKGROUND

Mobile communication devices have become increasingly common in current society for providing wireless communication services. The prevalence of these mobile communication devices is driven in part by the many functions that are now enabled on such devices. Increased processing capabilities in such devices means that mobile communication devices have evolved from being pure communication tools into sophisticated mobile multimedia centers that enable enhanced user experiences.

Fifth-generation (5G) wireless communication technology has been widely regarded as the next generation of wireless communication standards beyond the current third-generation (3G) and fourth-generation (4G) communication standards. A 5G-capable mobile communication device is expected to achieve significantly higher data rates, improved coverage range, enhanced signaling efficiency, and reduced latency compared to a conventional mobile communication device supporting only the 3G or the 4G communication standards.

For backward compatibility reasons, the 5G-capable mobile communication device may need to continue supporting 3G and/or 4G communication standards. As such, the 5G-capable mobile communication device may need to employ a number of antennas for radiating and/or absorbing electromagnetic waves in 3G/4G radio frequency (RF) spectrum and 5G RF spectrum. Typically, the 3G/4G RF spectrum covers such RF frequency bands located below 6 GHz, while the 5G RF spectrum covers such RF frequency bands located above 18 GHz (hereinafter also referred to as millimeter wave (mmWave) spectrum). As such, a 3G/4G electromagnetic wave will have a longer wavelength than a 5G electromagnetic wave. Accordingly, a 3G/4G antenna that radiates/absorbs the 3G/4G electromagnetic wave would have a larger area relative to a 5G antenna that radiates/absorbs the 5G electromagnetic wave.

Notably, the 5G-capable mobile communication device often employs multiple 3G/4G antennas for supporting such advanced operations as multiple-input multiple-output (MIMO). Likewise, the 5G-capable mobile communication device can also employ a 5G antenna array(s) consisting of a number of 5G antennas for supporting RF beamforming. As a result, the 5G-capable mobile communication device may have to pack both the 3G/4G antennas and the 5G antenna array(s) into a confined space. This may prove to be increasingly challenging as more and more sophisticated circuits and/or components are added to the 5G-capable mobile communication device to support an increasing number of new features and applications. Furthermore, the mmWave RF signal(s) can be susceptible to attenuation and interference resulting from various sources. For example, the mmWave RF signal(s) can be attenuated due to insertion loss associated with an interconnect medium(s) and/or interfered by clock spur coupling. As such, it may be desirable to reduce real estate occupied by 3G/4G/5G antennas and minimize mmWave signal attenuation in the 5G-capable mobile communication device.

SUMMARY

Embodiments of the disclosure relate to a multi-radio access technology (multi-RAT) antenna assembly and related front-end package. In one aspect, the multi-RAT antenna assembly includes a radiating structure (e.g., a metal layer) that radiates/absorbs a first electromagnetic wave corresponding to a first RAT in a first RF spectrum (e.g., below 6 GHz). A number of slot openings are created in the radiating structure to function as a number of slot antennas for radiating/absorbing a second electromagnetic wave corresponding to a second RAT in a second RF spectrum (e.g., above 18 GHz). As such, the multi-RAT antenna assembly is able to support both the first RAT and the second RAT based on the radiating structure, thus helping to reduce real estate requirements of the multi-RAT antenna assembly. In another aspect, a front-end circuit supporting the second RAT can be coupled to the slot openings via shortest possible paths (e.g., vias) in a front-end package, thus helping to reduce propagation attenuation in the front-end package.

In one aspect, a multi-RAT antenna assembly is provided. The multi-RAT antenna assembly includes a supporting structure. The multi-RAT antenna assembly also includes a radiating structure provided on the supporting structure. The radiating structure is configured to radiate a first outgoing electromagnetic wave corresponding to a first transmit signal encoded according to a first RAT in a first RF spectrum. The radiating structure includes a number of slot openings. The slot openings are configured to radiate a second outgoing electromagnetic wave corresponding to a second transmit signal encoded according to a second RAT in a second RF spectrum.

In another aspect, a front-end package is provided. The front-end package includes a multi-RAT antenna assembly. The multi-RAT antenna assembly includes a supporting structure. The multi-RAT antenna assembly also includes a radiating structure provided on the supporting structure. The radiating structure is configured to radiate a first outgoing electromagnetic wave corresponding to a first transmit signal encoded according to a first RAT in a first RF spectrum. The radiating structure includes a number of slot openings. The slot openings are configured to radiate a second outgoing electromagnetic wave corresponding to a second transmit signal encoded according to a second RAT in a second RF spectrum. The front-end package also includes at least one first front-end circuit coupled to the radiating structure. The at least one first front-end circuit is configured to provide the first transmit signal to the radiating structure such that the radiating structure is excited to radiate the first outgoing electromagnetic wave in the first RF spectrum. The front-end package also includes at least one second front-end circuit coupled to the number of slot openings. The at least one second front-end circuit is configured to provide the second transmit signal to the number of slot openings such that the number of slot openings is excited to radiate the second outgoing electromagnetic wave in the second RF spectrum.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1A:
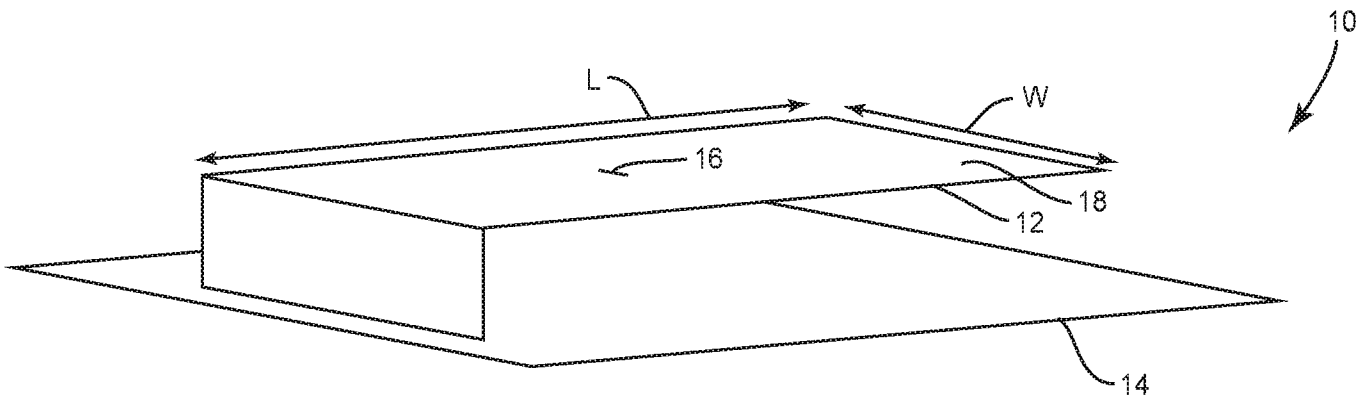
FIG. 1A (PRIOR ART)
FIG. 1A is a schematic diagram of an exemplary conventional planar inverted-F antenna (PIFA)

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Embodiments of the disclosure relate to a multi-radio access technology (multi-RAT) antenna assembly and related front-end package. In one aspect, the multi-RAT antenna assembly includes a radiating structure (e.g., a metal layer) that radiates/absorbs a first electromagnetic wave corresponding to a first RAT in a first RF spectrum (e.g., below 6 GHz). A number of slot openings are created in the radiating structure to function as a number of slot antennas for radiating/absorbing a second electromagnetic wave corresponding to a second RAT in a second RF spectrum (e.g., above 18 GHz). As such, the multi-RAT antenna assembly is able to support both the first RAT and the second RAT based on the radiating structure, thus helping to reduce real estate requirements of the multi-RAT antenna assembly. In another aspect, a front-end circuit supporting the second RAT can be coupled to the slot openings via shortest possible paths (e.g., vias) in a front-end package, thus helping to reduce propagation attenuation in the front-end package.

Figure 1B:
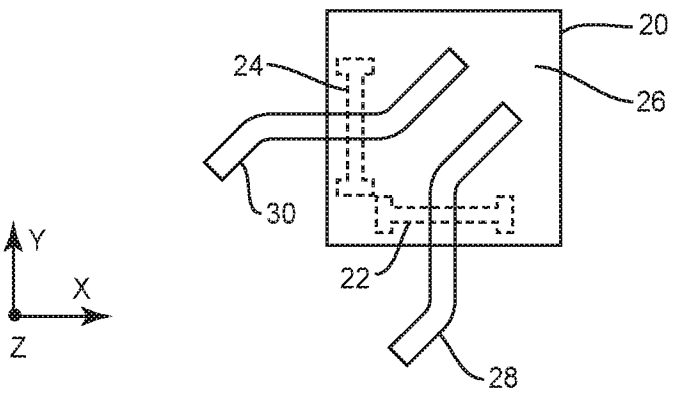
FIG. 1B (PRIOR ART)
FIG. 1B is a schematic diagram of an exemplary conventional slot antenna.

Before discussing a multi-RAT assembly and related front-end package of the present disclosure, a brief overview of a conventional planar inverted-F antenna (PIFA) and a conventional slot antenna is first provided with reference to FIGS. 1A and 1B to help understand challenges associated with providing multiple antennas in a mobile communication device. The discussion of specific exemplary aspects of a multi-RAT antenna assembly according to the present disclosure starts below with reference to FIG. 2A. The discussion of specific exemplary aspects of a front-end package incorporating the multi-RAT antenna assembly is provided subsequently with reference to FIG. 7A.

FIG. 1A is a schematic diagram of an exemplary conventional PIFA 10. The conventional PIFA 10 typically includes a radiating plane 12 running in parallel to a ground plane 14. The ground plane 14 may be conductively coupled to one end of the radiating plane 12, thus causing the radiating plane 12 to operate as a monopole antenna. The ground plane 14 may also be conductively coupled to a geometric center 16 of the radiating plane 12, thus causing the radiating plane 12 to operate as a dipole antenna.

The radiating plane 12 may be a rectangular-shaped plane corresponding to a radiating area 18 defined by a width W and a length L. The radiating area 18 is inversely related to a frequency of an electromagnetic wave radiated by the radiating plane 12. That is, the lower the frequency of the electromagnetic wave, the longer the wavelength of electromagnetic wage, and thus the larger the radiating area 18 of the radiating plane 12 is required.

FIG. 1B is a schematic diagram of an exemplary conventional slot antenna 20. The conventional slot antenna 20 includes a first slot 22 and a second slot 24 that are created in a metal plane 26. The first slot 22 may be parallel to an X-axis and the second slot 24 may be parallel to a Y-axis perpendicular to the X-axis. The first slot 22 and the second slot 24 may be excited by a first conductive trace 28 and a second conductive trace 30 to radiate an electromagnetic wave in a horizontal polarization and a vertical polarization, respectively. The respective shape and size of the first slot 22 and the second slot 24, as well as driving frequency, determine a radiation pattern of the electromagnetic wave radiated from the conventional slot antenna 20. The conventional slot antenna 20 may be more suited for radiating the electromagnetic wave in such higher frequency RF spectrum as the millimeter wave (mmWave) spectrum.

A mobile communication device may need to employ multiple antennas (e.g., the conventional PIFA 10) to enable multiple-input multiple-output (MIMO) operation in such wireless communications systems as long-term evolution (LTE). In addition, the mobile communication device may also need to employ an antenna array(s) consisting of multiple mmWave antennas for supporting RF beamforming in a fifth-generation (5G) communications system. As such, it may be desirable to optimize an antenna system in the mobile communication device to help ease real estate (e.g., footprint) requirements associated with the antenna system.

Figure 2A:
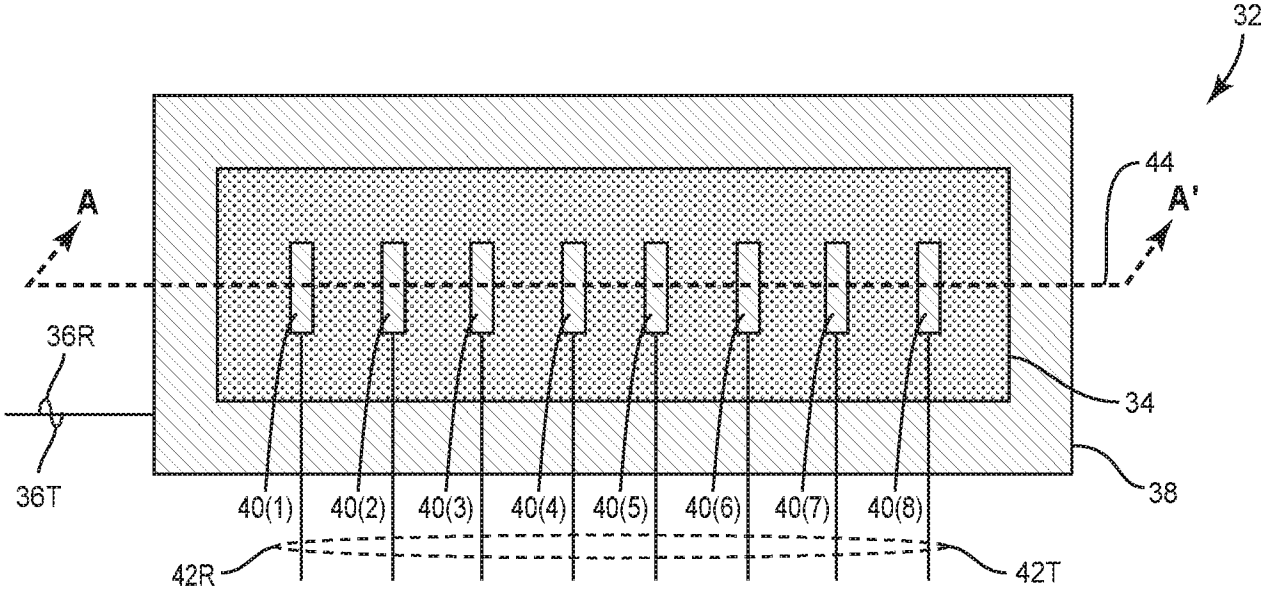
FIG. 2A is a schematic diagram providing a top view of an exemplary multi-radio access technology (multi-RAT) antenna assembly configured according to an embodiment of the present disclosure to enable first RAT and second RAT communications in a mobile communications device.

In this regard, FIG. 2A is a schematic diagram providing a top view of an exemplary multi-RAT antenna assembly 32 configured according an embodiment of the present disclosure to enable first RAT (e.g., LTE) and second RAT (e.g., 5G mmWave) communications in a mobile communications device. As discussed in detail below, the multi-RAT antenna assembly 32 includes a radiating structure 34 that radiates a first outgoing electromagnetic wave corresponding to a first transmit signal 36T encoded according to the first RAT in a first RF spectrum (e.g., below 6 GHz). The radiating structure 34 may be provided on a supporting structure 38. A number of slot openings 40(1)-40(8) are created in the radiating structure 34 to function as a number of slot antennas for radiating a second outgoing electromagnetic wave corresponding to a second transmit signal 42T encoded according to the second RAT in a second RF spectrum (e.g., above 18 GHz). Notably, the slot openings 40(1)-40(8) are discussed hereinafter merely as a non-limiting example. It should be appreciated that the radiating structure 34 can include more or less than eight slot openings as needed.

As such, the multi-RAT antenna assembly 32 is able to support both the first RAT and the second RAT based on the radiating structure 34. When the multi-RAT antenna assembly 32 radiates the first transmit signal 36T in the first RF spectrum, the radiating structure 34 is excited by the first transmit signal 36T and the slot openings 40(1)-40(8) have no significant impact on the radiating structure 34. In contrast, when the multi-RAT antenna assembly 32 radiates the second transmit signal 42T in the second RF spectrum, the slot openings 40(1)-40(8) will be excited by the second transmit signal 42T. Accordingly, the radiating structure 34 functions as an antenna array consisting of eight slot antennas to radiate the second outgoing electromagnetic wave in a formed RF beam. The second transmit signal 42T may be preprocessed (e.g., phase shifted) to ensure phase coherency in the formed RF beam radiated by the slot openings 40(1)-40(8).

In this regard, the multi-RAT antenna assembly is able to support both the first RAT and the second RAT based on the radiating structure 34. As the radiating structure 34 is already needed to support conventional third-generation (3G) and fourth-generation (4G) communications, it may be possible for the multi-RAT antenna assembly to further support 5G mmWave communications without occupying additional antennas, thus helping to reduce the real estate requirements of the multi-RAT antenna assembly 32.

Figure 2B:
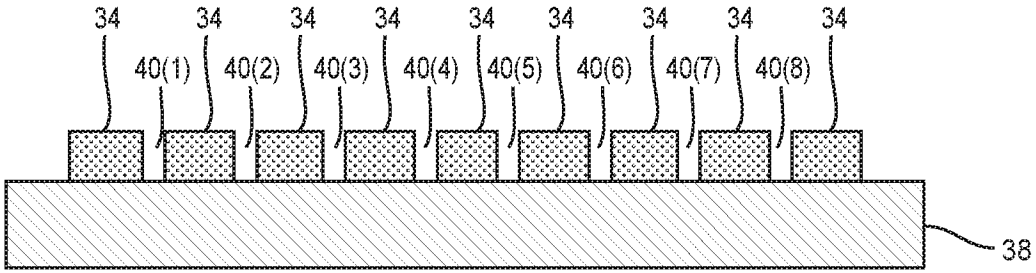
FIG. 2B is a schematic diagram providing a cross-section view of the multi-RAT antenna assembly of FIG. 2A.

FIG. 2B is a schematic diagram providing a cross-section view of the multi-RAT antenna assembly 32 of FIG. 2A along a cross-section line 44. Common elements between FIGS. 2A and 2B are shown therein with common element numbers and will not be re-described herein.

As shown in FIG. 2B, the radiating structure 34 is provided on the supporting structure 38 and the slot openings 40(1)-40(8) are created inside the radiating structure 34. In a non-limiting example, the supporting structure 38 can be a substrate or a laminate.

With reference back to FIG. 2A, the radiating structure 34 is further configured to absorb a first incoming electromagnetic wave corresponding to a first receive signal 36R encoded according to the first RAT in the first RF spectrum. Likewise, the slot openings 40(1)-40(8) are further configured to absorb a second incoming electromagnetic wave corresponding to a second receive signal 42R encoded according to the second RAT in the second RF spectrum. In this regard, the multi-RAT antenna assembly 32 is capable of radiating and absorbing electromagnetic waves in the first RF spectrum and the second RF spectrum without requiring additional space for housing additional antennas.

Although the slot openings 40(1)-40(8) are shown in FIG. 2A in a linear arrangement, it should be appreciated that the slot openings 40(1)-40(8) can be provided in an array with one or more rows and one or more columns. In this regard, FIG. 3A is a schematic diagram of an exemplary multi-RAT antenna assembly 32A in which the slot openings 40(1)-40(8) are provided in a two-by-four (2×4) array. Common elements between FIGS. 2A and 3A are shown therein with common element numbers and will not be re-described herein.

Figure 3B:
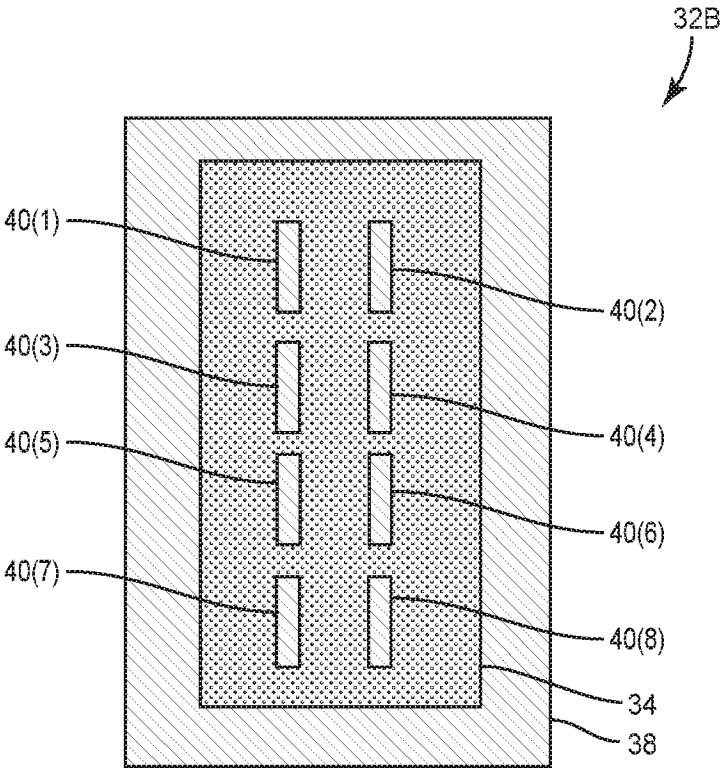
FIG. 3B is a schematic diagram of an exemplary multi-RAT antenna assembly in which a number of slot openings are provided in an array according to another embodiment of the present disclosure.
Figure 3A:
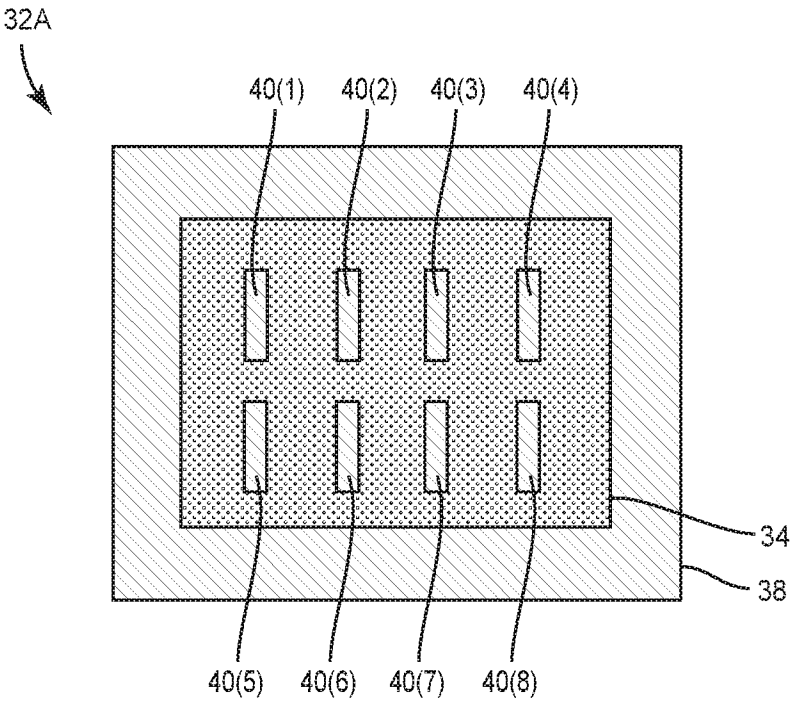
FIG. 3A is a schematic diagram of an exemplary multi-RAT antenna assembly in which a number of slot openings are provided in an array according to one embodiment of the present disclosure.

FIG. 3B is a schematic diagram of an exemplary multi-RAT antenna assembly 32B in which the slot openings 40(1)-40(8) are provided in a four-by-two (4×2) array. Common elements between FIGS. 2A and 3B are shown therein with common element numbers and will not be re-described herein.

It should be appreciated from illustrations in FIGS. 3A and 3B that the slot openings 40(1)-40(8), and any additional number of slot openings, can be provided in any suitable number of rows and any suitable number of columns. It should be further appreciated that it may not be necessary for the slot openings 40(1)-40(8) to be provided in a symmetrical arrangement relative to the radiating structure 34. For example, all of the slot openings 40(1)-40(8) can be provided close to the left or the right side of the radiating structure 34, as opposed being in the middle of the radiating structure 34.

The multi-RAT antenna assembly 32 of FIG. 2A can be further modified to radiate the second outgoing electromagnetic wave in horizontal and/or vertical polarization, as discussed next with reference to FIGS. 4A and 4B. In examples discussed herein, a horizontal polarization is said to be parallel to an X-axis (e.g., earth's horizon) and a vertical polarization is said to be perpendicular to the X-axis or parallel to a Y-axis. Common elements between FIGS. 2A, 4A, and 4B are shown therein with common element numbers and will not be re-described herein.

Figure 4A:
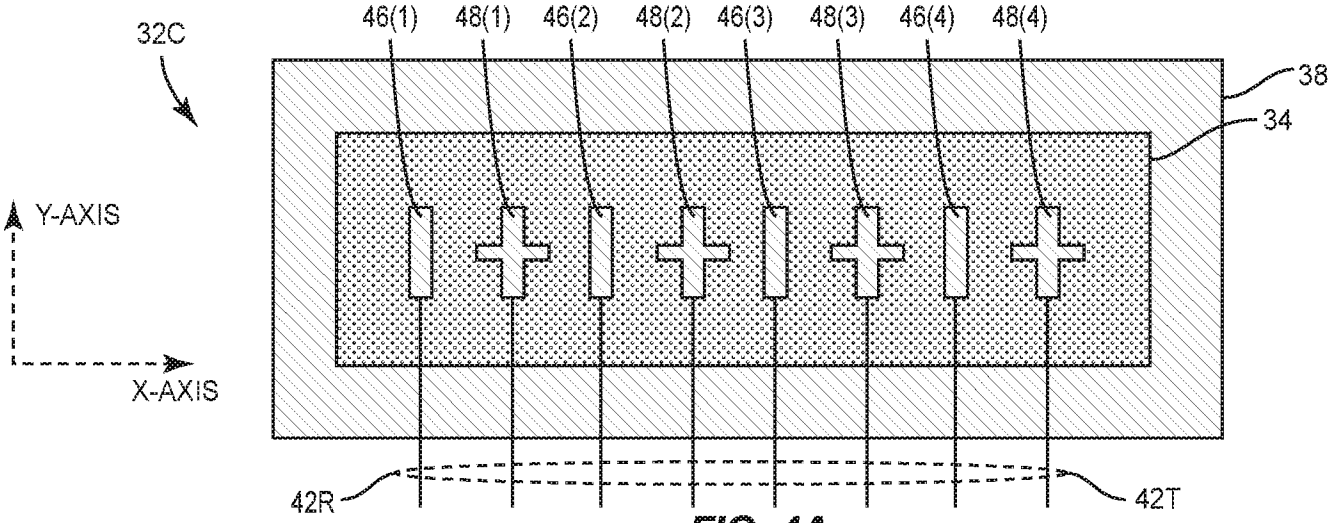
FIG. 4A is a schematic diagram of an exemplary multi-RAT antenna assembly configured according to one embodiment of the present disclosure to radiate in horizontal and/or vertical polarization.

FIG. 4A is a schematic diagram of an exemplary multi-RAT antenna assembly 32C configured according to one embodiment of the present disclosure to radiate in horizontal and/or vertical polarization. The multi-RAT antenna assembly 32C includes a number of first slot openings 46(1)-46(4) and a number of second slot openings 48(1)-48(4). In a non-limiting example, the first slot openings 46(1)-46(4) are rectangular-shaped slot openings and the second slot openings 48(1)-48(4) are cross-shaped slog openings.

When only the first slot openings 46(1)-46(4) are excited, the multi-RAT antenna assembly 32C radiates in vertical polarization. When only the second slot openings 48(1)-48(4) are excited, the multi-RAT antenna assembly 32C radiates in horizontal polarization (or in circular polarization). When the first slot openings 46(1)-46(4) and the second slot openings 48(1)-48(4) are all excited, the multi-RAT antenna assembly 32C radiates in both horizontal and vertical polarizations.

Figure 4B:
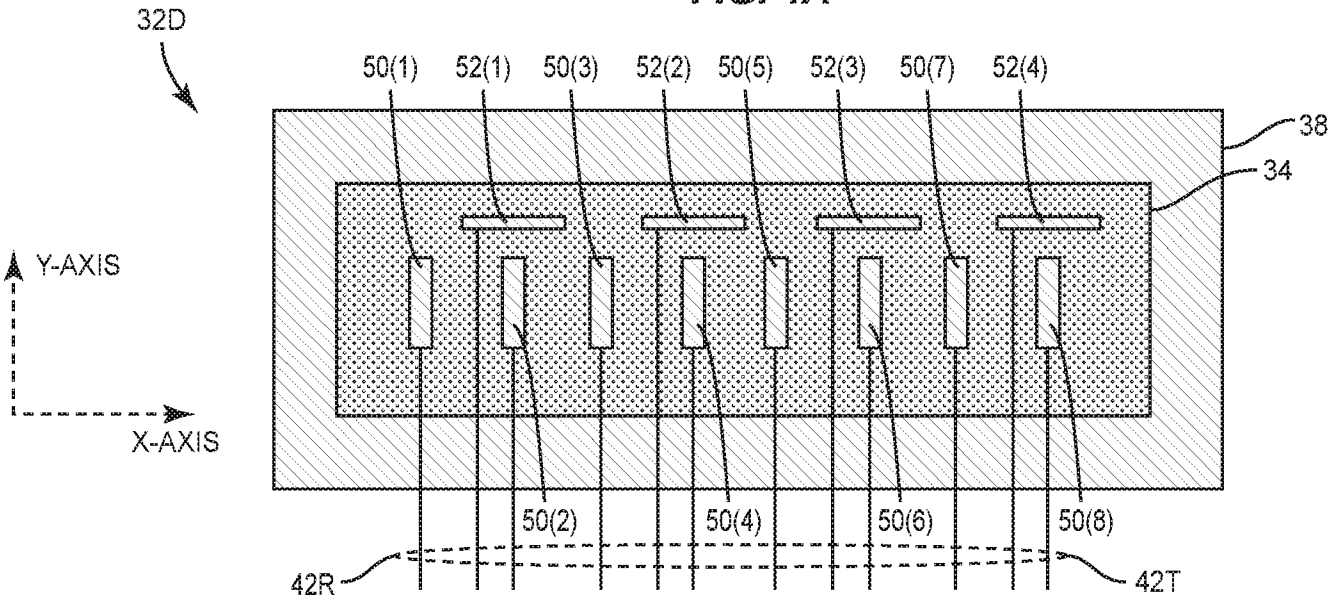
FIG. 4B is a schematic diagram of an exemplary multi-RAT antenna assembly configured according to another embodiment of the present disclosure to radiate in horizontal and/or vertical polarization.

FIG. 4B is a schematic diagram of an exemplary multi-RAT antenna assembly 32D configured according to another embodiment of the present disclosure to radiate in horizontal and/or vertical polarization. The multi-RAT antenna assembly 32C includes a number of first slot openings 50(1)-50(8) and a number of second slot openings 52(1)-52(4). In a non-limiting example, the first slot openings 50(1)-50(8) and the second slot openings 52(1)-52(4) are all rectangular-shaped slot openings.

When only the first slot openings 50(1)-50(8) are excited, the multi-RAT antenna assembly 32D radiates in vertical polarization. When only the second slot openings 52(1)-52(4) are excited, the multi-RAT antenna assembly 32D radiates in horizontal polarization. When the first slot openings 50(1)-50(8) and the second slot openings 52(1)-52(4) are all excited, the multi-RAT antenna assembly 32D radiates in both horizontal and vertical polarizations.

The multi-RAT antenna assembly 32 of FIG. 2A can be adapted to support multiple frequency bands in the second RF spectrum, as discussed next with reference to FIGS. 5A and 5B. Common elements between FIGS. 2A, 5A, and 5B are shown therein with common element numbers and will not be re-described herein.

Figure 5A:
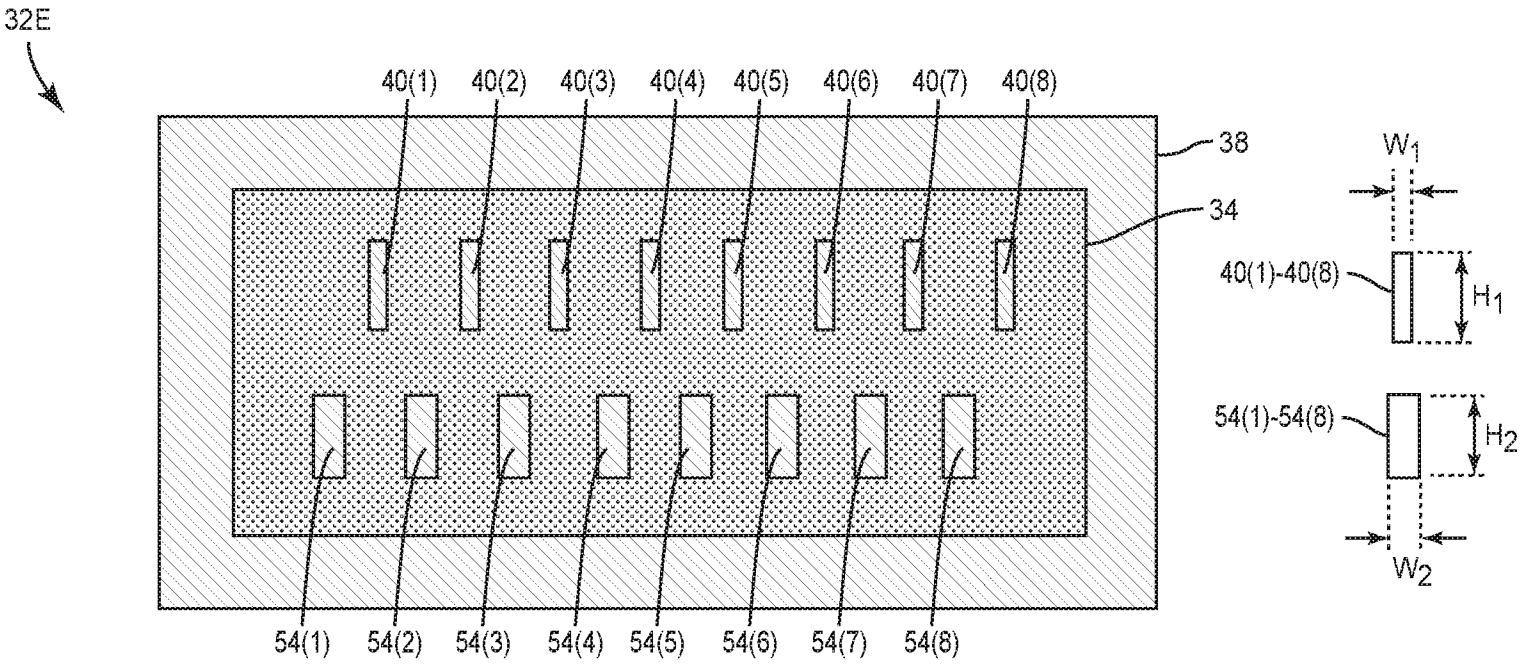
FIG. 5A is a schematic diagram of an exemplary multi-RAT antenna assembly configured according to one embodiment of the present disclosure to radiate electromagnetic waves in different millimeter wave (mmWave) bands.
Figure 5B:
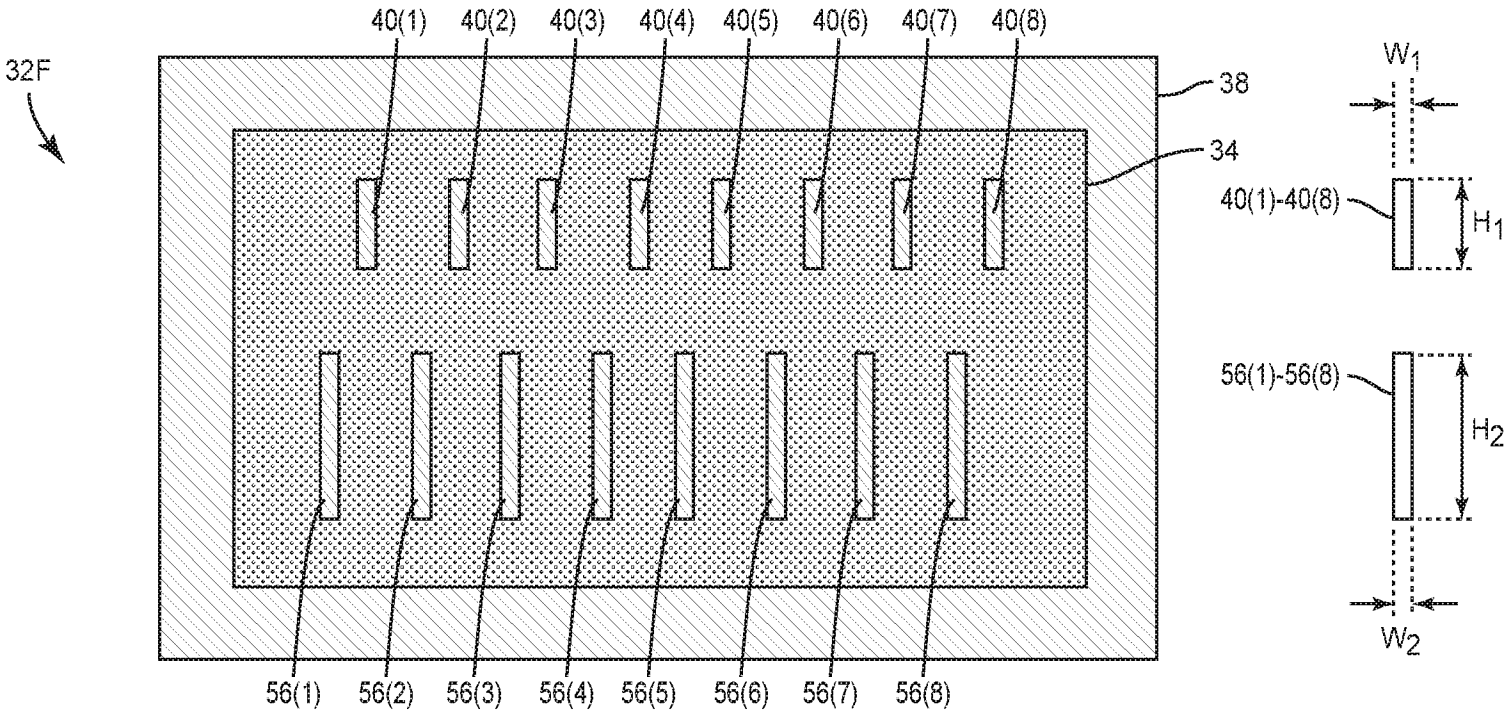
FIG. 5B is a schematic diagram of an exemplary multi-RAT antenna assembly configured according to another embodiment of the present disclosure to radiate electromagnetic waves in different mmWave bands.

FIG. 5A is a schematic diagram of an exemplary multi-RAT antenna assembly 32E configured according to one embodiment of the present disclosure to radiate electromagnetic waves in different mmWave bands. The multi-RAT antenna assembly 32E includes a number of second slot openings 54(1)-54(8). Notably, FIG. 5A merely provides an exemplary illustration of one possible arrangement of the slot openings 40(1)-40(8) and the second slot openings 54(1)-54(8). It should be appreciated that the slot openings 40(1)-40(8) and the second slot openings 54(1)-54(8) can be provided in the radiating structure 34 according to any suitable arrangement as previously discussed in FIGS. 3A, 3B, 4A, and 4B without affecting operational principles of the multi-RAT antenna assembly 32E.

In a non-limiting example, the slot openings 40(1)-40(8) and the second slot openings 54(1)-54(8) are rectangular-shaped slots. Each of the slot openings 40(1)-40(8) corresponds to a first height $H_1$ and a first width $W_1$. The first height $H_1$ is equal among all of the slot openings 40(1)-40(8) and the first width $W_1$ is equal among all of the slot openings 40(1)-40(8). Each of the second slot openings 54(1)-54(8) corresponds to a second height $H_2$ and a second width $W_2$. The second height $H_2$ is equal among all of the second slot openings 54(1)-54(8) and the second width $W_2$ is equal among all of the second slot openings 54(1)-54(8).

According to the non-limiting example in FIG. 5A, the first height $H_1$ equals the second height $H_2$ ($H_1=H_2$) while the first width $W_1$ is smaller than the second width $W_2$ ($W_1<W_2$). In this regard, the second slot openings 54(1)-54(8) are wider than the slot openings 40(1)-40(8). As a result, the slot openings 40(1)-40(8) can be excited to radiate the second outgoing electromagnetic wave in a higher frequency section of the second RF spectrum, while the second slot openings 54(1)-54(8) can be excited to radiate the second outgoing electromagnetic wave in a lower frequency section of the second RF spectrum. It should be noted that exact dimensions of the slot openings 40(1)-40(8) and the second slot openings 54(1)-54(8) may vary depending on permittivity of the radiating structure 34.

FIG. 5B is a schematic diagram of an exemplary multi-RAT antenna assembly 32F configured according to another embodiment of the present disclosure to radiate electromagnetic waves in different mmWave bands. The multi-RAT antenna assembly 32F includes a number of second slot openings 56(1)-56(8). Notably, FIG. 5B merely provides an exemplary illustration of one possible arrangement of the slot openings 40(1)-40(8) and the second slot openings 56(1)-56(8). It should be appreciated that the slot openings 40(1)-40(8) and the second slot openings 56(1)-56(8) can be provided in the radiating structure 34 according to any suitable arrangement as previously discussed in FIGS. 3A, 3B, 4A, and 4B without affecting operational principles of the multi-RAT antenna assembly 32F.

In a non-limiting example, the slot openings 40(1)-40(8) and the second slot openings 56(1)-56(8) are rectangular-shaped slots. Each of the slot openings 40(1)-40(8) corresponds to a first height $H_1$ and a first width $W_1$. The first height $H_1$ is equal among all of the slot openings 40(1)-40(8) and the first width $W_1$ is equal among all of the slot openings 40(1)-40(8). Each of the second slot openings 56(1)-56(8) corresponds to a second height $H_2$ and a second width $W_2$. The second height $H_2$ is equal among all of the second slot openings 56(1)-56(8) and the second width $W_2$ is equal among all of the second slot openings 56(1)-56(8).

According to the non-limiting example in FIG. 5B, the first height $H_1$ is shorter than the second height $H_2$ ($H_1<H_2$) while the first width $W_1$ equals the second width $W_2$ ($W_1=W_2$). In this regard, the second slot openings 56(1)-56(8) are taller than the slot openings 40(1)-40(8). As a result, the slot openings 40(1)-40(8) can be excited to radiate the second outgoing electromagnetic wave in a higher frequency section of the second RF spectrum, while the second slot openings 56(1)-56(8) can be excited to radiate the second outgoing electromagnetic wave in a lower frequency section of the second RF spectrum. It should be noted that exact dimensions of the slot openings 40(1)-40(8) and the second slot openings 56(1)-56(8) may vary depending on permittivity of the radiating structure 34.

In the multi-RAT antenna assembly 32 of FIG. 2A, the multi-RAT antenna assembly 32A of FIG. 3A, the multi-RAT antenna assembly 32B of FIG. 3B, the multi-RAT antenna assembly 32C of FIG. 4A, the multi-RAT antenna assembly 32D of FIG. 4B, the multi-RAT antenna assembly 32E of FIG. 5A, and the multi-RAT antenna assembly 32F of FIG. 5B, the radiating structure 34 is shown as being a planar radiating structure. However, it may also be possible to provide the radiating structure 34 as a non-planar radiating structure.

Figure 6:
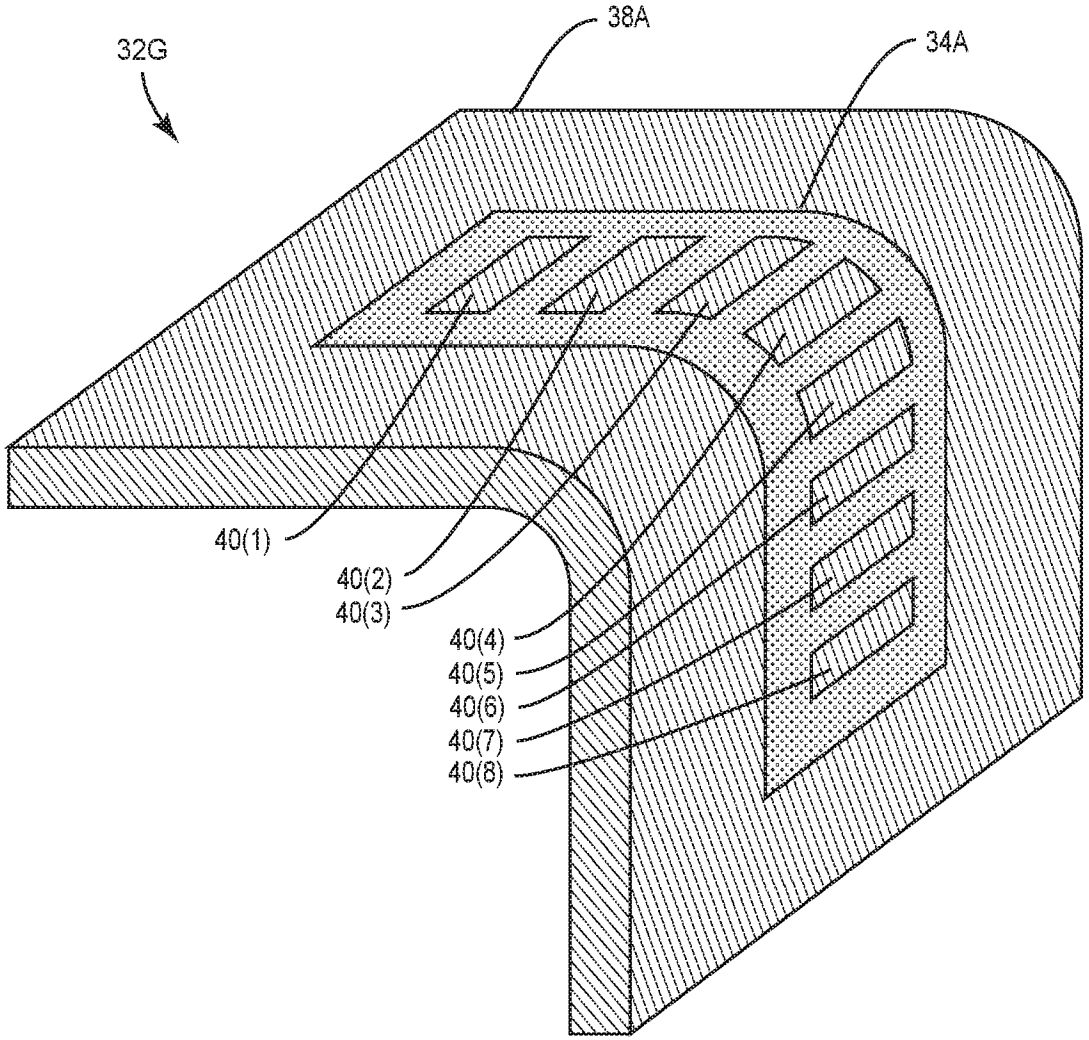
FIG. 6 is a schematic diagram of an exemplary multi-RAT antenna assembly having a curved radiating structure.

In this regard, FIG. 6 is a schematic diagram of an exemplary multi-RAT antenna assembly 32G having a curved radiating structure 34A. Common elements between FIGS. 2A and 6 are shown therein with common element numbers and will not be re-described herein. As shown in FIG. 6, the multi-RAT antenna assembly 32G also includes a curved supporting structure 38A.

Figure 7A:
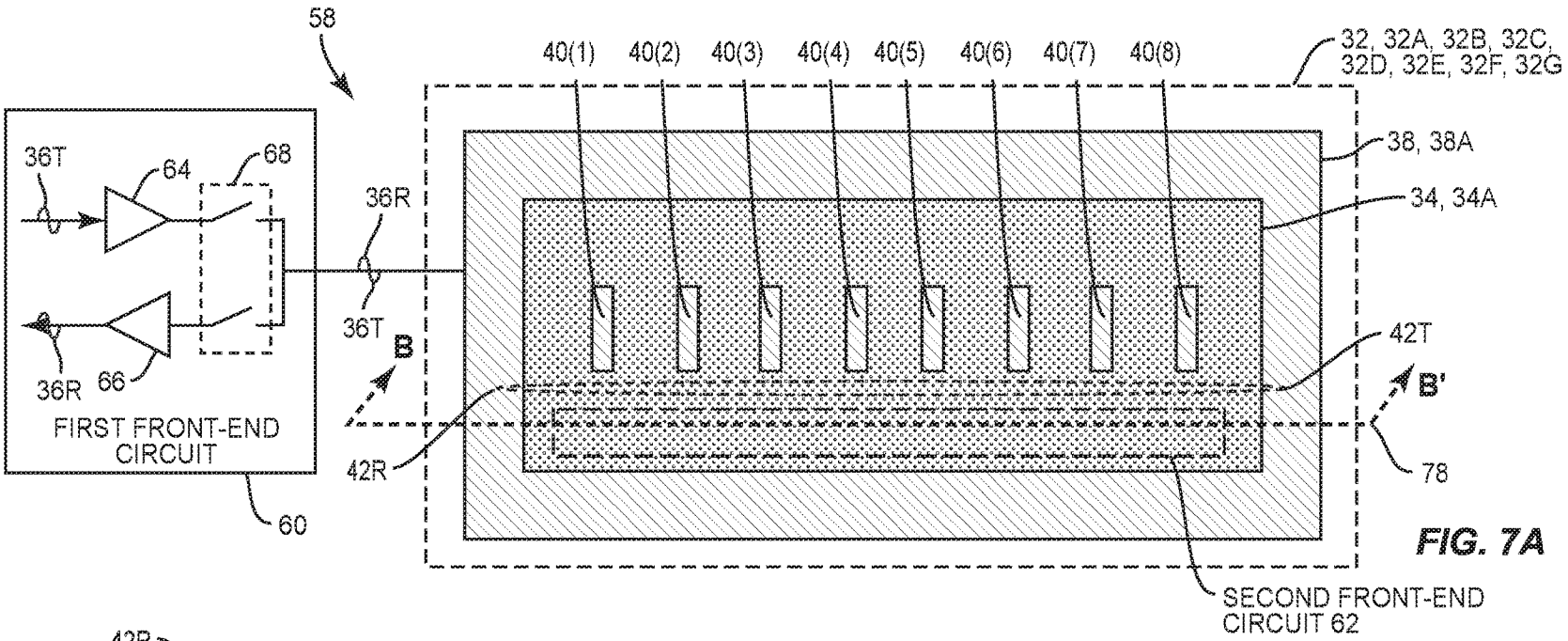
FIG. 7A is a schematic diagram providing a top view of an exemplary front-end package configured to include the multi-RAT antenna assembly of FIG. 2A, 2B, 3A, 3B, 4A, 4B, 5A, 5B, or 6 according to an embodiment of the present disclosure.

The multi-RAT antenna assembly 32 of FIG. 2A, the multi-RAT antenna assembly 32A of FIG. 3A, the multi-RAT antenna assembly 32B of FIG. 3B, the multi-RAT antenna assembly 32C of FIG. 4A, the multi-RAT antenna assembly 32D of FIG. 4B, the multi-RAT antenna assembly 32E of FIG. 5A, the multi-RAT antenna assembly 32F of FIG. 5B, or the multi-RAT antenna assembly 32G of FIG. 6 can be packaged with other front-end circuits to form a front-end package. In this regard, FIG. 7A is a schematic diagram providing a top view of an exemplary front-end package 58 configured to include the multi-RAT antenna assembly 32 of FIG. 2A, the multi-RAT antenna assembly 32A of FIG. 3A, the multi-RAT antenna assembly 32B of FIG. 3B, the multi-RAT antenna assembly 32C of FIG. 4A, the multi-RAT antenna assembly 32D of FIG. 4B, the multi-RAT antenna assembly 32E of FIG. 5A, the multi-RAT antenna assembly 32F of FIG. 5B, or the multi-RAT antenna assembly 32G of FIG. 6. Common elements between FIGS. 2A-2B, 3A-3B, 4A-4B, 5A-5B, 6 and 7A are shown therein with common element numbers and will not be re-described herein.

The front-end package 58 includes at least one first front-end circuit 60 and at least one second front-end circuit 62. In a non-limiting example, the first front-end circuit 60 can be a power management integrated circuit (PMIC) configured to support operations in the first RF spectrum and the second front-end circuit 62 can be a PMIC configured to support operations in the second RF spectrum. The first front-end circuit 60 includes a first power amplifier 64 and a first low-noise amplifier (LNA) 66. The first power amplifier 64 and the first LNA 66 may be coupled to the radiating structure 34 via a first switching circuit 68. In this regard, the first power amplifier 64 is configured to amplify and provide the first transmit signal 36T to the radiating structure 34 such that the radiating structure 34 can be excited to radiate the first outgoing electromagnetic wave in the first RF spectrum. The first LNA 66 is configured to receive the first receive signal 36R absorbed by the radiating structure 34.

Figure 7B:
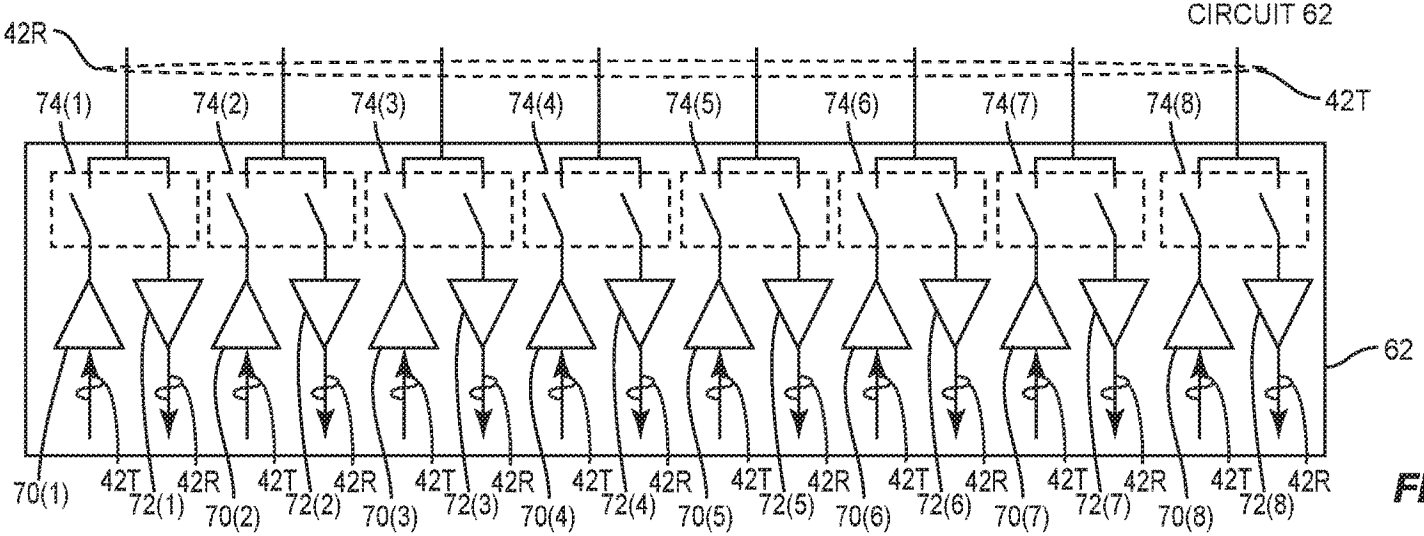
FIG. 7B is a schematic diagram providing an exemplary illustration of a front-end circuit in the front-end package of FIG. 7A.

The second front-end circuit 62 is coupled to the slot openings 40(1)-40(8). FIG. 7B is a schematic diagram providing an exemplary illustration of the second front-end circuit 62 of FIG. 7A. Common elements between FIGS. 2A, 7A, and 7B are shown therein with common element numbers and will not be re-described herein.

The second front-end circuit 62 includes a number of second power amplifiers 70(1)-70(8) and a number of second LNAs 72(1)-72(8). The second power amplifiers 70(1)-70(8) are coupled to the slot openings 40(1)-40(8) via a number of second switching circuits 74(1)-74(8), respectively. In this regard, the second power amplifiers 70(1)-70(8) are configured to amplify and provide the second transmit signal 42T to the slot openings 40(1)-40(8) such that the slot openings 40(1)-40(8) can be excited to radiate the second outgoing electromagnetic wave in the second RF spectrum. The second LNAs 72(1)-72(8) are also coupled to the slot openings 40(1)-40(8) via the second switching circuits 74(1)-74(8), respectively. Accordingly, the second LNAs 72(1)-72(8) can receive the second receive signal 42R absorbed by the slot openings 40(1)-40(8).

Figure 8A:
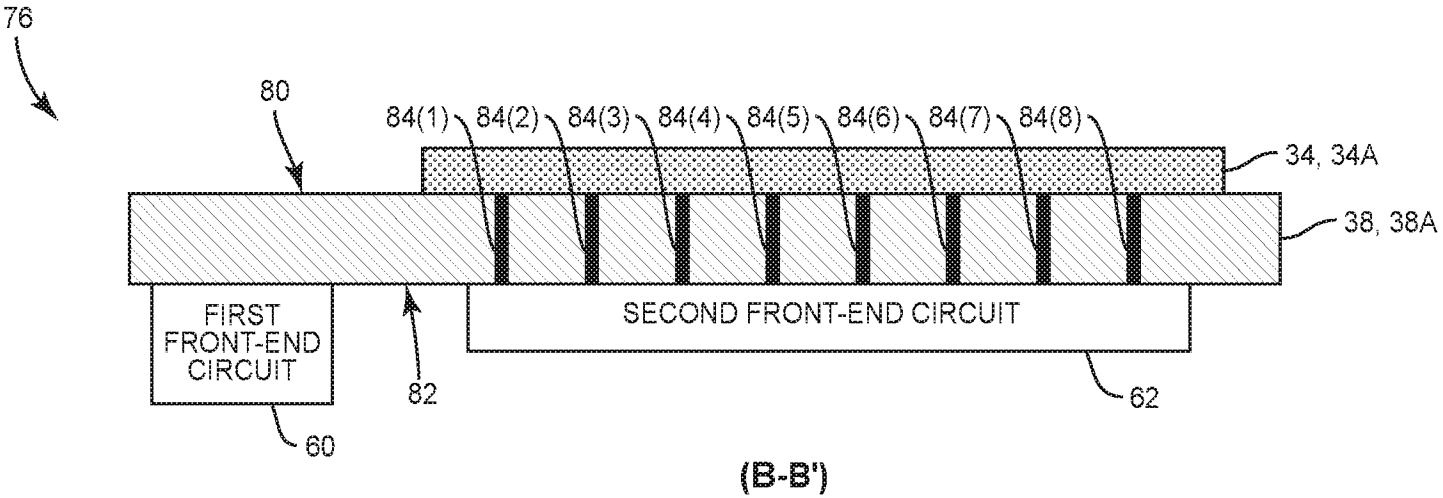
FIG. 8A is a schematic diagram providing an exemplary cross-section view of the front-end package of FIG. 7A according to one embodiment of the present disclosure.

FIG. 8A is a schematic diagram providing an exemplary cross-section view 76 of the front-end package 58 of FIG. 7A according to one embodiment of the present disclosure. Notably, the cross-section view 76 is generated along a cross-section line 78 in FIG. 7A. Common elements between FIGS. 7A and 8A are shown therein with common element numbers and will not be re-described herein.

The supporting structure 38 has a top surface 80 and a bottom surface 82. The radiating structure 34 is provided on the top surface 80 of the supporting structure 38. The first front-end circuit 60 and the second front-end circuit 62 are provided on the bottom surface 82 of the supporting structure 38. In a non-limiting example, the second front-end circuit 62 can be coupled to the slot openings 40(1)-40(8) (not shown) via a number of conductive vias 84(1)-84(8) between the top surface 80 and the bottom surface 82.

Figure 8B:
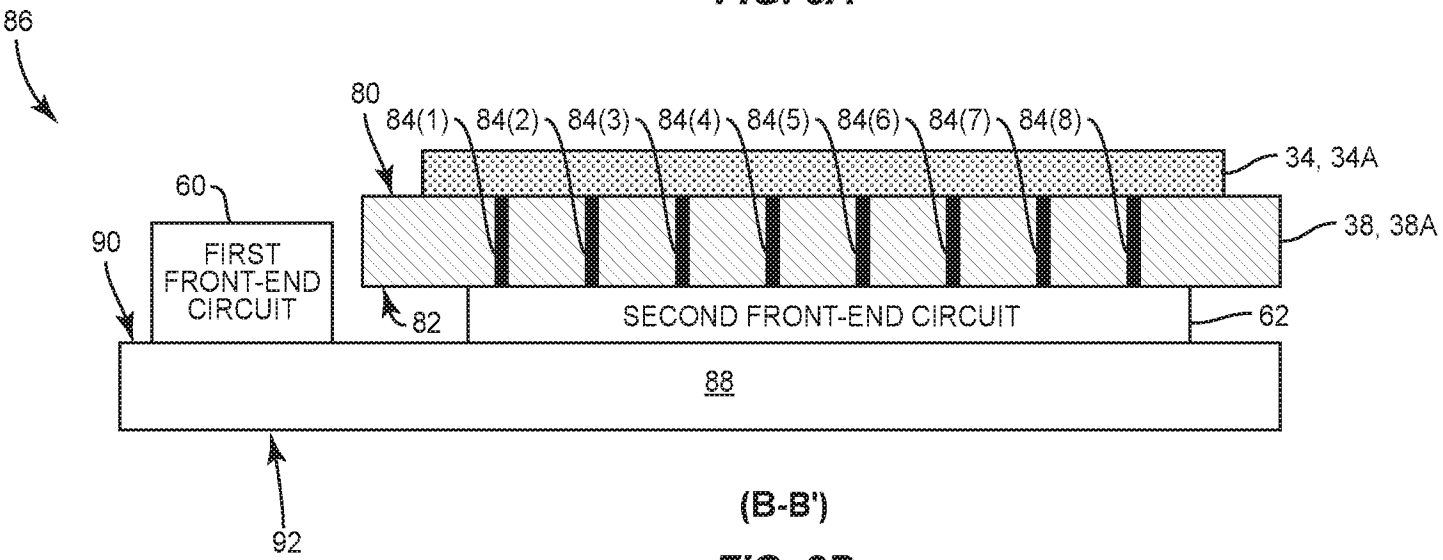
FIG. 8B is a schematic diagram providing an exemplary cross-section view of the front-end package of FIG. 7A according to another embodiment of the present disclosure.

FIG. 8B is a schematic diagram providing an exemplary cross-section view 86 of the front-end package 58 of FIG. 7A according to another embodiment of the present disclosure. Notably, the cross-section view 86 is generated along a cross-section line 78 in FIG. 7A. Common elements between FIGS. 8A and 8B are shown therein with common element numbers and will not be re-described herein.

The front-end package 58 may include a second supporting structure 88 that includes a second top surface 90 and a second bottom surface 92. The first front-end circuit 60 may be provided on the second top surface 90, independent of the supporting structure 38. The second front-end circuit 62, on the other hand, is sandwiched between the bottom surface 82 of the supporting structure 38 and the second top surface 90 of the second supporting structure.

Figure 9:
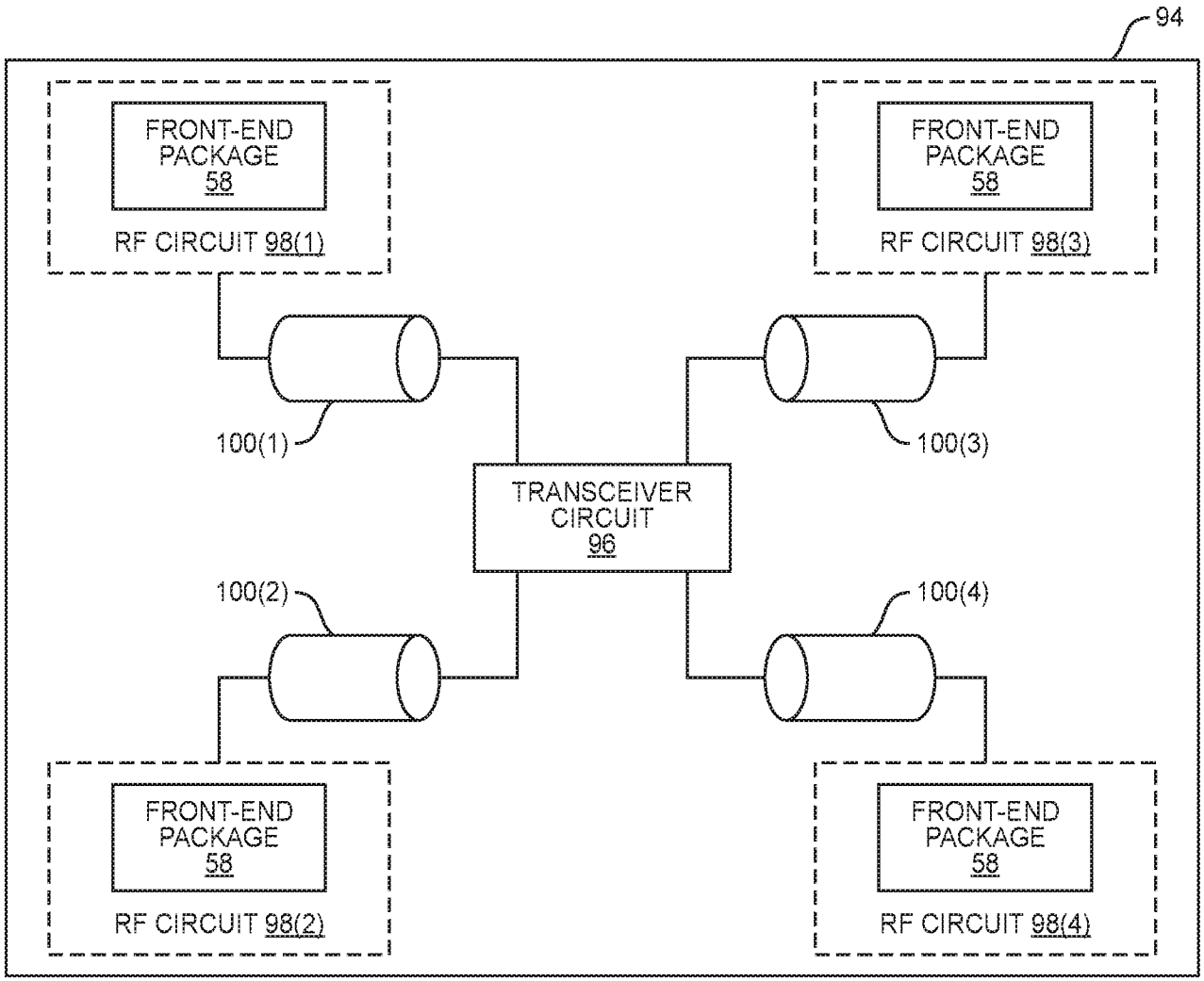
FIG. 9 is a schematic diagram of an exemplary multi-RAT apparatus configured to include the front-end package of FIG. 7A.

Multiple front-end packages, such as the front-end package of FIG. 7A, can be provided in a multi-RAT apparatus (e.g., a smartphone). In this regard, FIG. 9 is a schematic diagram of an exemplary multi-RAT apparatus 94 configured to include the front-end package 58 of FIG. 7A.

The multi-RAT apparatus 94 includes at least one transceiver circuit 96 and a number of RF circuits 98(1)-98(4), and a number of interconnect mediums 100(1)-100(4). Accordingly, the transceiver circuit 96 is coupled to the RF circuits 98(1)-98(4) via the interconnect mediums 100(1)-100(4), respectively.

Each of the RF circuits 98(1)-98(4) includes the front-end package 58 of FIG. 7A. Although the multi-RAT apparatus 94 is shown to include only the RF circuits 98(1)-98(4) and the interconnect mediums 100(1)-100(4), it should be appreciated that the multi-RAT apparatus 94 can be configured to include any suitable number of RF circuits and interconnect mediums based on a variety of topologies. It should also be appreciated that the transceiver circuit 96 can be implemented with multiple transceiver circuits and/or transceiver sub-systems.

Those skilled in the art will recognize improvements and modifications to the preferred embodiments of the present disclosure. All such improvements and modifications are considered within the scope of the concepts disclosed herein and the claims that follow.

What is claimed is:

1. A multi-radio access technology (multi-RAT) antenna assembly comprising:

a supporting structure; and a radiating structure provided on the supporting structure and configured to radiate a first outgoing electromagnetic wave corresponding to a first transmit signal encoded according to a first RAT in a first radio frequency (RF) spectrum;

wherein the radiating structure comprises a plurality of slot openings configured to radiate a second outgoing electromagnetic wave corresponding to a second transmit signal encoded according to a second RAT in a second RF spectrum, wherein each pair of adjacent slot openings among the plurality of slot openings is configured to have different geometric shapes.

2. The multi-RAT antenna assembly of claim 1 wherein:

the radiating structure is further configured to absorb a first incoming electromagnetic wave corresponding to a first receive signal encoded according to the first RAT in the first RF spectrum; and the plurality of slot openings is further configured to absorb a second incoming electromagnetic wave corresponding to a second receive signal encoded according to the second RAT in the second RF spectrum.

3. The multi-RAT antenna assembly of claim 1 wherein the first RF spectrum and the second RF spectrum correspond to RF frequencies below 6 GHz and above 18 GHz, respectively.

4. The multi-RAT antenna assembly of claim 1 wherein the radiating structure is provided as a planar radiating structure.

5. The multi-RAT antenna assembly of claim 1 wherein the radiating structure is provided as a curved radiating structure.

6. The multi-RAT antenna assembly of claim 1 wherein the plurality of slot openings is provided in one or more rows and one or more columns.

7. The multi-RAT antenna assembly of claim 1 wherein the plurality of slot openings is further configured to radiate the second outgoing electromagnetic wave in horizontal polarizations.

8. The multi-RAT antenna assembly of claim 1 wherein the plurality of slot openings is further configured to radiate the second outgoing electromagnetic wave in vertical polarizations.

9. The multi-RAT antenna assembly of claim 1 wherein:

a first number of the plurality of slot openings are configured to radiate the second outgoing electromagnetic wave in horizontal polarizations; and a second number of the plurality of slot openings are configured to radiate the second outgoing electromagnetic wave in vertical polarizations.

10. The multi-RAT antenna assembly of claim 1 wherein:

the plurality of slot openings is provided as a plurality of rectangular-shaped slot openings; and each of the plurality of slot openings corresponds to an equal height and an equal width.

11. The multi-RAT antenna assembly of claim 10 wherein:

the radiating structure further comprises a plurality of second slot openings having equal heights as respective heights of the plurality of slot openings and wider widths than respective widths of the plurality of slot openings;

the plurality of slot openings is configured to radiate the second outgoing electromagnetic wave in a higher frequency section of the second RF spectrum; and the plurality of second slot openings is configured to radiate the second outgoing electromagnetic wave in a lower frequency section of the second RF spectrum.

12. The multi-RAT antenna assembly of claim 10 wherein:

the radiating structure further comprises a plurality of second slot openings having higher heights than respective heights of the plurality of slot openings and equal widths as respective widths of the plurality of slot openings;

the plurality of slot openings is configured to radiate the second outgoing electromagnetic wave in a higher frequency section of the second RF spectrum; and the plurality of second slot openings is configured to radiate the second outgoing electromagnetic wave in a lower frequency section of the second RF spectrum.

13. A front-end package comprising:

a multi-radio access technology (multi-RAT) antenna assembly comprising:

a supporting structure; and a radiating structure provided on the supporting structure and configured to radiate a first outgoing electromagnetic wave corresponding to a first transmit signal encoded according to a first RAT in a first radio frequency (RF) spectrum;

wherein the radiating structure comprises a plurality of slot openings configured to radiate a second outgoing electromagnetic wave corresponding to a second transmit signal encoded according to a second RAT in a second RF spectrum, wherein each pair of adjacent slot openings among the plurality of slot openings is configured to have different geometric shapes;

at least one first front-end circuit coupled to the radiating structure and configured to provide the first transmit signal to the radiating structure such that the radiating structure is excited to radiate the first outgoing electromagnetic wave in the first RF spectrum;

at least one second front-end circuit coupled to the plurality of slot openings and configured to provide the second transmit signal to the plurality of slot openings such that the plurality of slot openings is excited to radiate the second outgoing electromagnetic wave in the second RF spectrum; and a second supporting structure, wherein:

the at least one second front-end circuit is further provided on a top surface of the second supporting structure; and the at least one first front-end circuit is provided on the top surface of the second supporting structure independent of the supporting structure.

14. The front-end package of claim 13 wherein:

the radiating structure is further configured to absorb a first incoming electromagnetic wave corresponding to a first receive signal encoded according to the first RAT in the first RF spectrum;

the plurality of slot openings is further configured to absorb a second incoming electromagnetic wave corresponding to a second receive signal encoded according to the second RAT in the second RF spectrum;

the at least one first front-end circuit is further configured to receive the first receive signal; and the at least one second front-end circuit is further configured to receive the second receive signal.

15. The front-end package of claim 14 wherein:

the at least one first front-end circuit comprises a first power amplifier and a first low-noise amplifier (LNA), wherein:

the first power amplifier is configured to amplify the first transmit signal to excite the radiating structure to radiate the first outgoing electromagnetic wave in the first RF spectrum; and the first LNA is configured to receive and amplify the first receive signal; and the at least one second front-end circuit comprises a plurality of second power amplifiers and a plurality of second LNAs coupled to the plurality of slot openings, respectively, wherein:

the plurality of second power amplifiers is configured to amplify the second transmit signal to excite the plurality of slot openings to radiate the second outgoing electromagnetic wave in the second RF spectrum; and the plurality of second LNAs is configured to receive and amplify the second receive signal.

16. The front-end package of claim 14 wherein:

the radiating structure is provided on a top surface of the supporting structure; and the at least one second front-end circuit is provided on a bottom surface of the supporting structure and coupled to the plurality of slot openings via a plurality of conductive vias provided between the top surface and the bottom surface of the supporting structure.

17. The front-end package of claim 16 wherein the at least one first front-end circuit is provided on the bottom surface of the supporting structure.

18. The front-end package of claim 13 wherein the first RF spectrum and the second RF spectrum correspond to RF frequencies below 6 GHz and above 18 GHz, respectively.

19. The front-end package of claim 13 wherein the plurality of slot openings is configured to radiate the second outgoing electromagnetic wave in a horizontal polarization and/or a vertical polarization.

* * * * *